United States Patent [19]

Kernodle, Sr.

[11] Patent Number: 4,782,957

[45] Date of Patent: Nov. 8, 1988

[54] LOCKABLE FLANGED ITEM CADDY

[76] Inventor: James W. Kernodle, Sr., Rt. 2, Box 542, Durham, N.C. 27705

[21] Appl. No.: 51,050

[22] Filed: May 15, 1987

[51] Int. Cl.[4] ..... A47F 7/00

[52] U.S. Cl. ..... 211/13; 211/74

[58] Field of Search ..... 211/13, 74, 41, 94, 211/89, 71, 69.2, 70.6; 206/487

[56] References Cited

U.S. PATENT DOCUMENTS

| | | | |
|---|---|---|---|
| 1,925,540 | 9/1933 | Neuschotz | 218/23 |
| 2,068,526 | 1/1937 | Zimmerman | 120/73 |
| 2,400,832 | 5/1946 | Kress | 312/118 |
| 2,963,167 | 12/1960 | Norman | 211/74 |
| 3,233,804 | 2/1966 | Dahm | 224/48 |
| 3,266,533 | 8/1966 | McHale | 141/364 |
| 3,893,569 | 7/1975 | Hoch | 211/74 |
| 3,964,709 | 6/1976 | Labelle et al. | 211/74 X |
| 4,008,810 | 11/1977 | Merz | 211/71 |
| 4,040,549 | 8/1977 | Sadler | 224/29 |
| 4,378,889 | 4/1983 | Lebowitz | 211/75 |
| 4,687,108 | 8/1987 | Kernodle, Sr. | 211/13 |

OTHER PUBLICATIONS

Kernodle, Flanged Item Holder, Patent Application Ser. No. 06/891,130, now U.S. Pat. No. 4,687,108, issued 8/18/87.

*Primary Examiner*—J. Franklin Foss
*Assistant Examiner*—Sarah A. Lechok Eley
*Attorney, Agent, or Firm*—Lynn E. Barber

[57] ABSTRACT

The invention comprises a support structure for receiving and lockably holding various items. The support structure has one or more of a variety of receiving structures in its upper surface. Container bases to which containers may be attached or which are formed in one piece with the container bases fit in a particular receiving structure and may be locked into place in the support structure. This invention permits organizing bottles, containers and caps for various felt markers and wirting instruments of various sizes and for holding them securely in a fixed position so that they may be easily opened and closed with only one hand while at the same time allowing them to be easily removed from the support.

18 Claims, 8 Drawing Sheets

LOCKABLE FLANGED ITEM CADDY

FIELD OF THE INVENTION

The present invention relates to a device for organizing, securely holding, and supporting small items such as those commonly found on desks.

BACKGROUND OF THE INVENTION

It is often difficult for persons engaged in the graphic arts, or others, who work with small bottles, containers and drawing implements such as markers of various sizes, to keep the containers neatly organized, upright and available for easy use. It is also often inconvenient or difficult, especially for handicapped persons, to use both hands to open and close the bottles and markers. Many prior art supports and holders only have holes or openings in which to set the bottles loosely. Others hold the bottles so firmly that easy removal of the bottles is not possible. This invention provides a device for organizing such bottles and containers and for holding them securely in a fixed position so that they may be easily opened and closed with only one hand while at the same time allowing the bottles to be easily removed from the support. This invention is an improvement over the inventor's prior invention (Ser. No. 06/891,130) now U.S. Pat. No. 4,687,108 and the prior art in that it provides a support that is designed to allow locking of the containers into place on the support and also to allow easy unlocking for removal of the containers from the support.

OBJECTS OF THE INVENTION

One object of the invention is to provide a device that can be used to support and hold bottles and containers of various sizes.

Another object of the invention is to provide a device that can be used to organize differently sized objects.

Another object of the invention is to provide a device that can hold a variety of containers by providing standard sized flanges for the containers.

Another object of the invention is to provide a device that can be inexpensively constructed.

Another object of the invention is to provide a device that allows bottles and other containers easily to be locked into position on a support structure as well as easily to be removed from that position.

Still other objects and advantages of the invention will become apparent to those of skill in the art after reading the following description of preferred embodiments.

SUMMARY OF THE INVENTION

The invention is comprised of a lockable flanged item caddy support structure having one or more types of receiving structures capable of receiving a variety of containers by means of container bases styled to fit the particular type or receiving structure and into which receiving structure the container bases may be locked into place. The items such as bottles or other containers may be attached to the container base by a variety of means.

DESCRIPTION OF THE PREFERRED EMBODIMENTS

Figure 1:
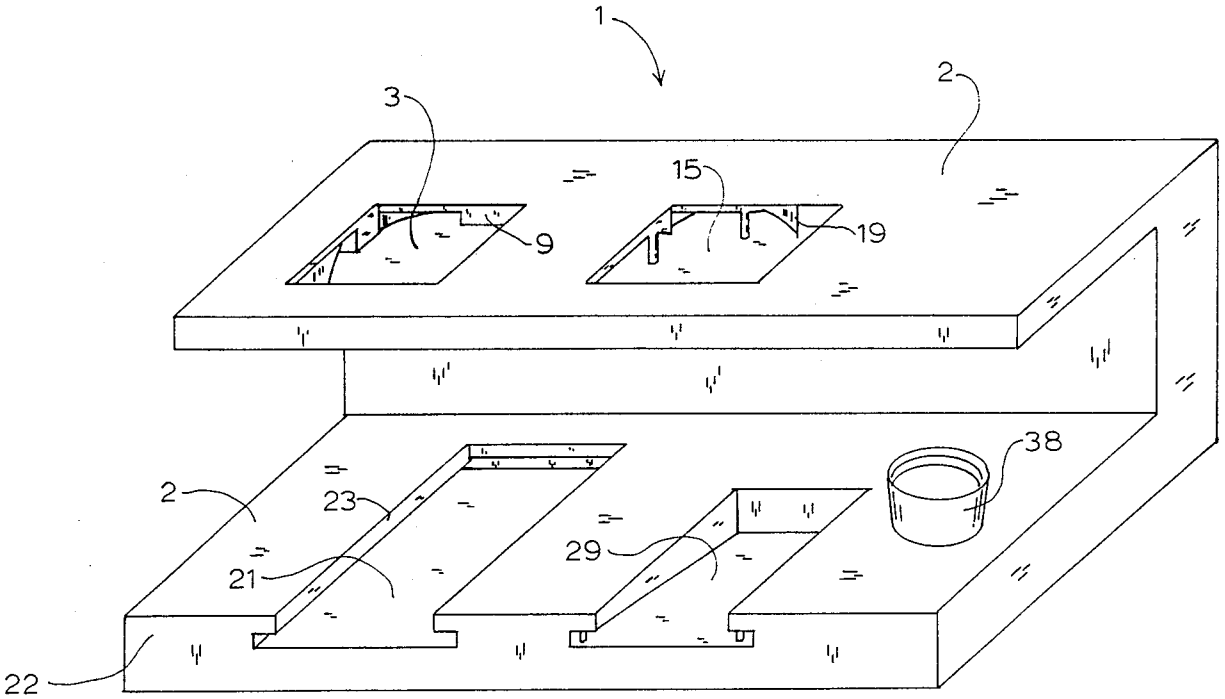
FIG. 1 is a perspective view of one embodiment of the invention, which discloses a two-level caddy with a variety of receiving structures.
Figure 20:
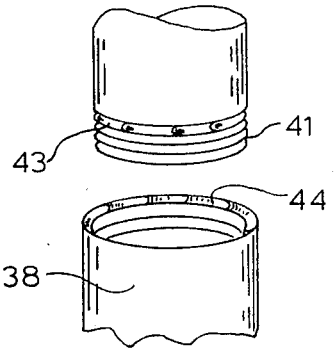
FIG. 20 is a perspective view of protrusions and a container fixture of the invention.
Figure 21:
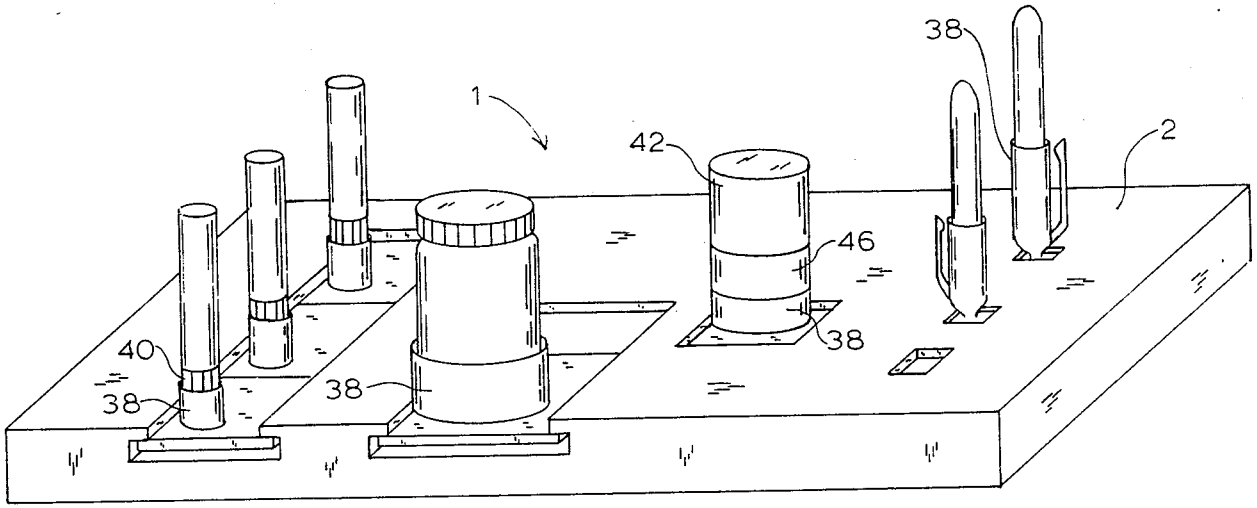
FIG. 21 is a perspective view of one embodiment of the invention showing containers, container fixtures and container bases.

The shape and size of the caddy 1 of the invention, which may have any number of receiving structures, may be designed to fit many use or space constraints and may contain one or more levels to receive containers. Each receiving structure is a depression in an upper plane and is designed to fit a particular container base design. The upper plane 2 of each level may be horizontal, slanted or curved or a combination of more than one plane. An embodiment of the invention is shown in FIG. 1 in which the item caddy 1 has various embodiments of receiving structures for container bases. FIGS. 2–16 are perspective, diagrammatic and cross-sectional view of the embodiments of the container bases and receiving structures as discussed individually in more detail below. FIGS. 17–20 are embodiments of the container fixtures. FIG. 21 shows the caddy 1 with container fixtures in the receiving structures.

Figure 2:
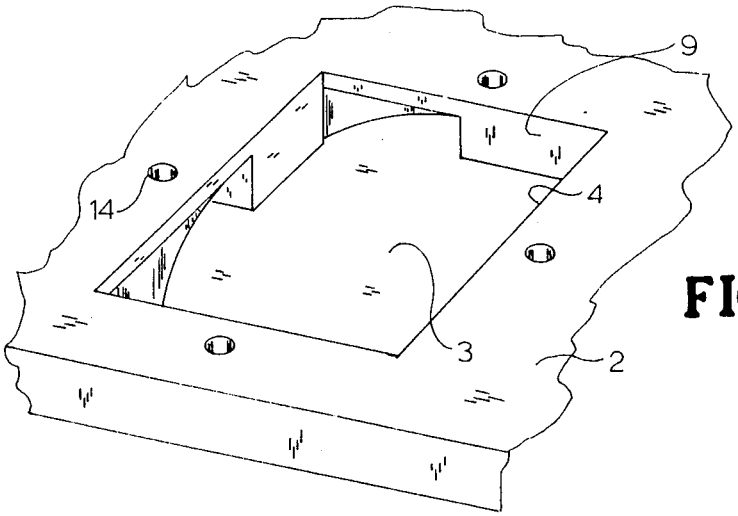
FIG. 2 is another perspective view of one embodiment of the invention, which discloses the first receiving structure.
Figure 3:
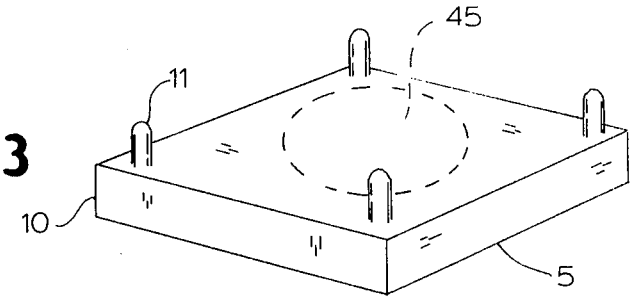
FIG. 3 is a perspective view of the first container base of the invention.
Figure 4:
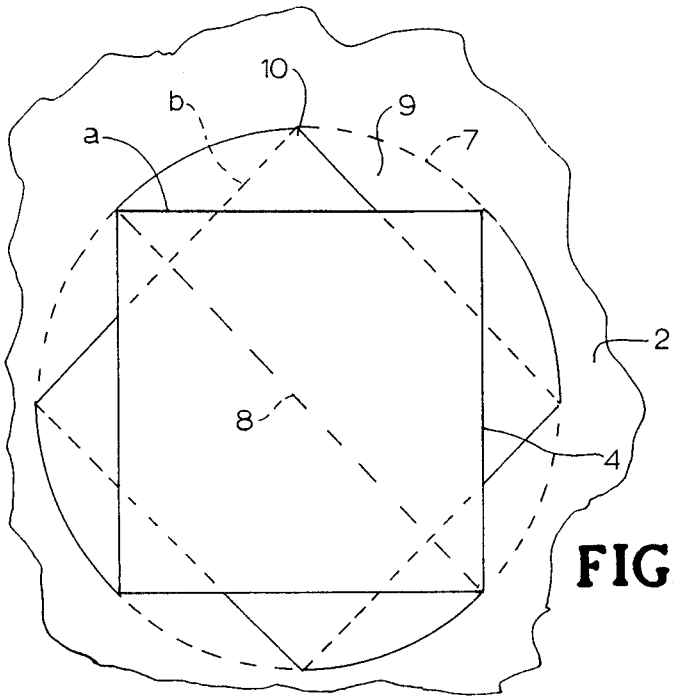
FIG. 4 is a diagrammatic representation of the top of the first receiving structure of the invention.
Figure 5:
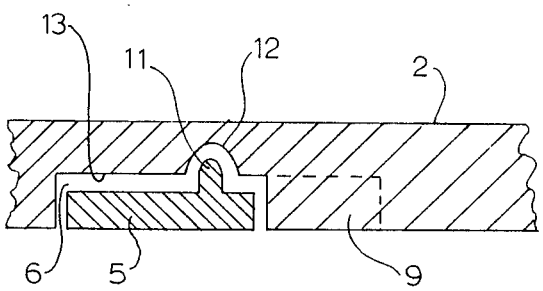
FIG. 5 is a cross-sectional side view along the edge of the first receiving structure and the first container base of the invention.
Figure 6:
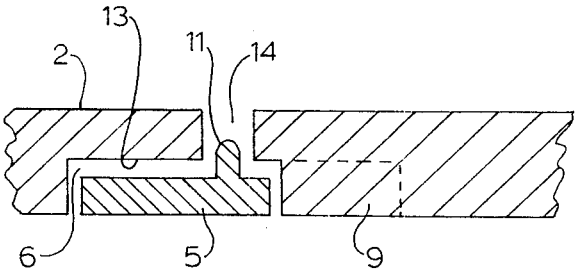
FIG. 6 is a cross-sectional side view of a variation of the first receiving structure design of the invention.
Figure 7:
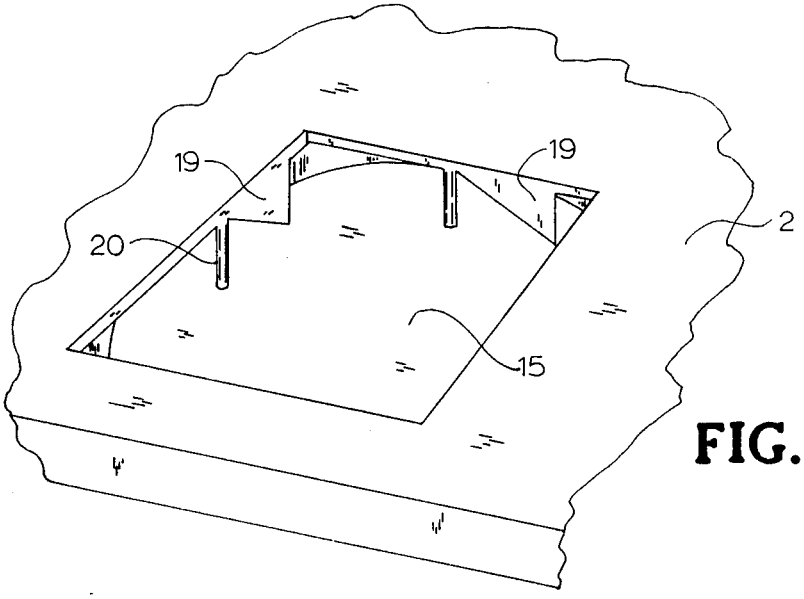
FIG. 7 is a perspective view of one embodiment of the invention, which discloses the second receiving structure.
Figure 8:
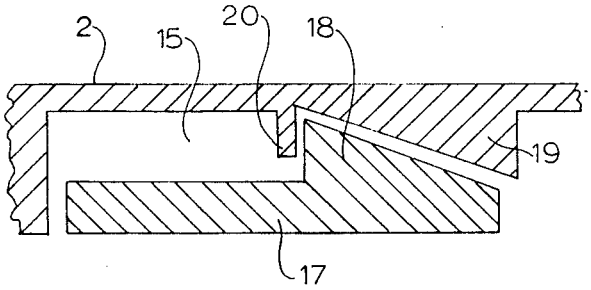
FIG. 8 is a cross-sectional view of the second container base in the second receiving structure.
Figure 9:
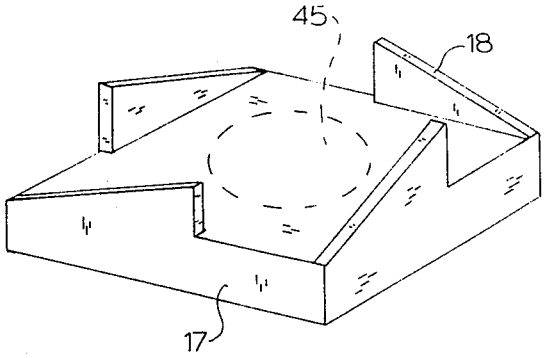
FIG. 9 is a perspective view of the second container base of the invention.
Figure 10:
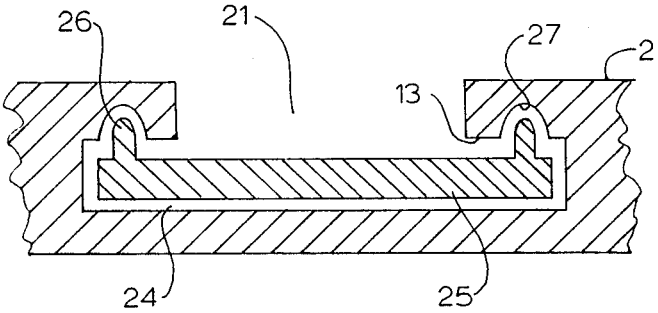
FIG. 10 is a cross-sectional view of the third container base in the third receiving structure of the invention.

In FIGS. 2-6, the first receiving structure 3 is comprised of a square opening 4 in the upper plane 2 of the caddy 1 through which the square first container base 5 (FIG. 5) is placed. The shape of the interior 6 of the receiving structure 3 beneath the upper plane 2 is derived from a circle 7 having a diameter equal to the diagonal 8 of the square container base 5, which circle 7 has preferably four periodically spaced indentational stops 9 such that the square container base 5 may be rotated from position a to position b (FIG. 4), with the corners of the square container base 5 coming to rest against the stops 9 and beneath the side of the square opening 4 that is cut in the upper plane 2. In this position, the base 5 cannot be removed from the receiving structure 3 without rotation because the four tips 10 of the square container base 5 are beneath the upper plane 2. To enhance the locking effect, the container base 5 may be provided with upwardly projecting knobs 11 which either fit into indentations 12 in the lower surface 13 of the upper plane 2 (FIG. 5) or in holes 14 through the upper plane 2 (FIGS. 2 and 6). These knobs 11 are preferably of plastic or other flexible material so that with sufficient downward and rotational pressure they may be disengaged from the indentations 12 or holes 14 for removal of the container base 5 from the receiving structure 3.

The second receiving structure 15 in the preferred embodiment (FIGS. 7-9) is also comprised of a square opening 16 in the upper plane 2 of the caddy 1 through which the square second container base 17 (FIG. 9) is placed. To accommodate locking of the second container base 17 in the second receiving structure 15, wedge-shaped base projections 18 on the second container base 17 are designed to butt against angled stops 19 projecting downward from the upper plane 2. To enhance the locking effect, a downward-hanging flexible catch 20 may be provided to stop the corner of the base projection 18 from moving unless moderate force is exerted. Both the first and second receiving structures are best used for containers and implements having slip-on caps such as marking pens because if used with containers having screw-on caps, the process of opening or closing the caps may cause the container base to turn in the receiving structure.

Figure 11:
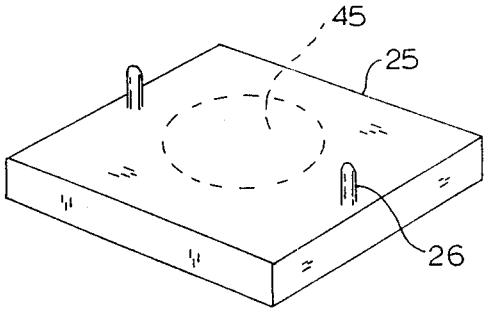
FIG. 11 is a perspective view of the third containeir base of the invention.
Figure 12:
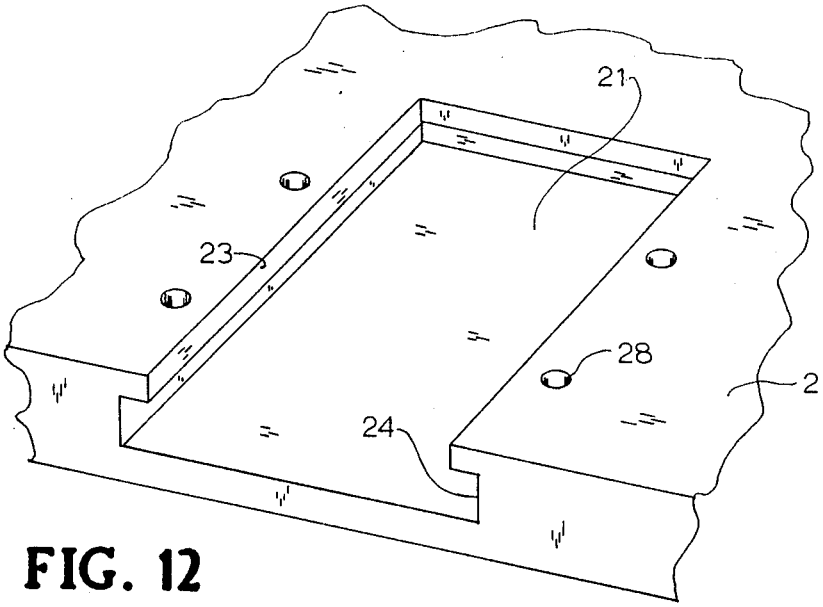
FIG. 12 is a perspective view of the third receiving structure of the invention.
Figure 13:
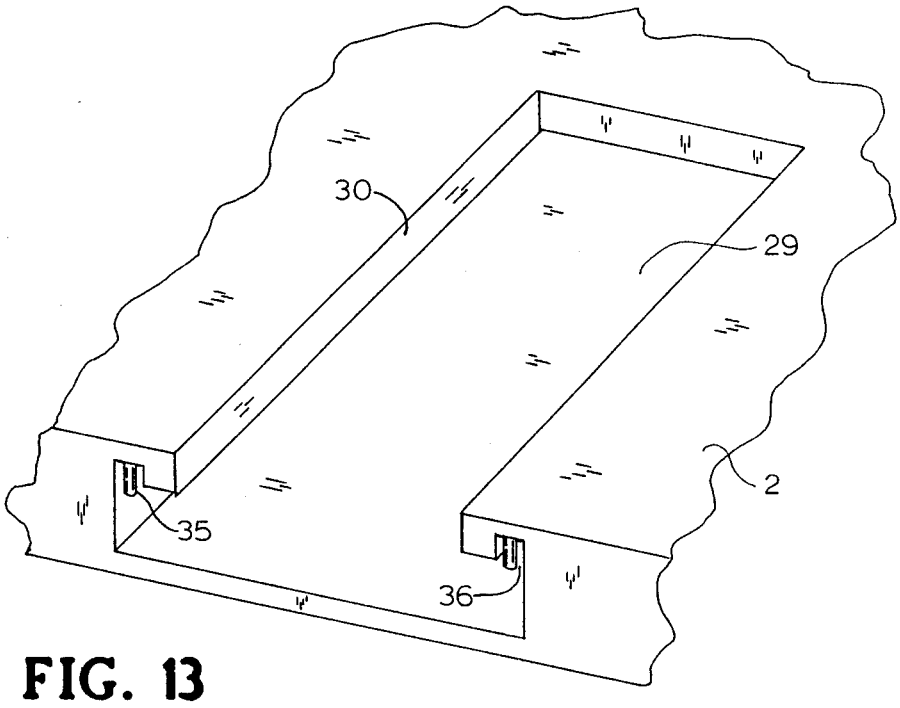
FIG. 13 is a perspective view of one embodiment of the fourth receiving structure of the invention.

The third receiving structure 21 may open at any edge 22 of the item caddy 1 (FIGS. 1-2). The sides 23 of the third receiving structure 21 are parallel to each other and may be perpendicular to or at other angles to the edge 22 of the caddy 1. The upper plane 2 of the caddy 1 overhangs the sides 23 of the receiving structure 21 to form a track 24 in which the third container base 25 slides. The third container base 25 need not be rectangular but must have two parallel sides. As shown in FIG. 11, upwardly projecting knobs 26 on the sides of the third container base 25 fit into either indentations 27 in the lower surface 13 of the upper plane 2 (FIG. 10) or in holes 28 through the upper plane 2 (FIG. 12). These knobs 26 are preferably of plastic or other flexible material so that they may be disengaged from the indentations 27 or holes 28 for removal of the base 25 from the receiving structure 21. As shown in FIG. 12 the receiving structure 21 may have more than one set of indentations 27 or holes 28 along its sides 23 to allow for placement of the third container base 25 at more than one position or to allow for placement of more than one container base 25 in the receiving structure 21.

Figure 14:
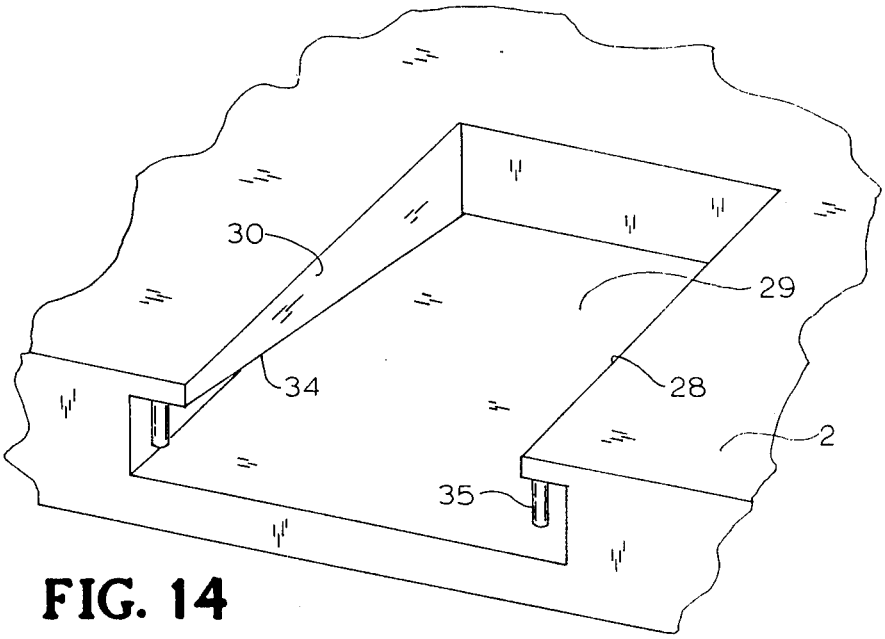
FIG. 14 is a perspective view of another embodiment of the fourth container base of the invention.
Figure 15:
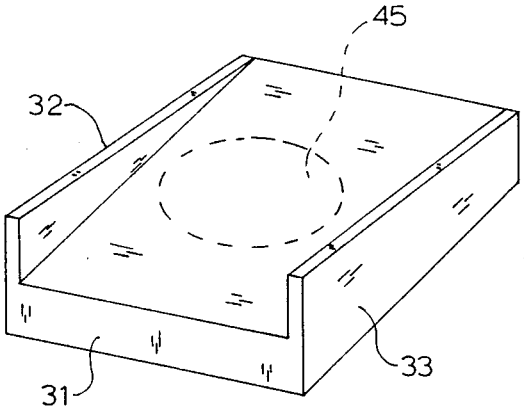
FIG. 15 is a perspective view of one embodiment of the fourth container base of the invention.
Figure 16:
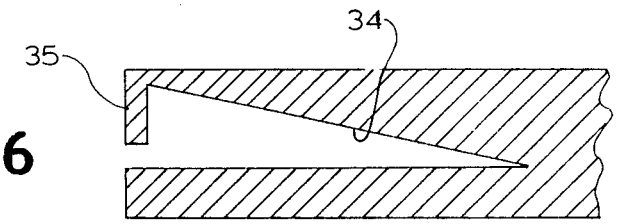
FIG. 16 is a cross-sectional view of the edge of the fourth receiving structure of the invention.

The fourth receiving structure 29 may also open at any edge of the item caddy 1. The sides 30 of the fourth receiving structure 29 are parallel to each other for use with a rectangular container base 31 or may be angled for use with an angled container base. In either case, the fourth container base 31, has wedges 32 along the side edges 33. The fourth receiving structure 29 has an upper track surface 34 inclined downward from the opening into which the wedges 32 along the side edges 33 of the container base 31 may slide (FIG. 16). An end catch 35 of flexible sturdy material allows the fourth container base 31 to be locked in place in the fourth receiving structure 29 until pressure is exerted. The amount of pressure required to unlock the container base 31 in this embodiment as well as in the others obviously will depend on the type of material used for the catch 35. The fourth receiving structure 29 may have a slanted groove 36 in the upper plane 2 into which the wedge 32 slides and which has a catch 35 at the tall end of the slanted groove 36 (FIG. 13), or the upper track surface 34 may be a slanted lower surface of the overhanging upper plane 2 (FIG. 14).

Figure 17:
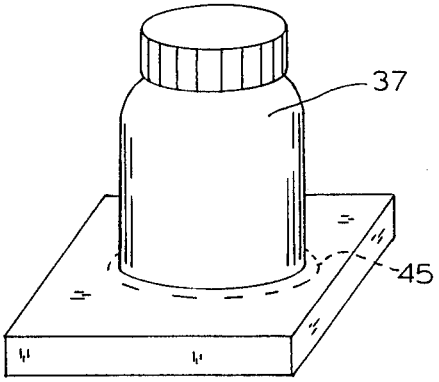
FIG. 17 is a perspective view of a bottle attached directly to a container base of the invention.
Figure 18:
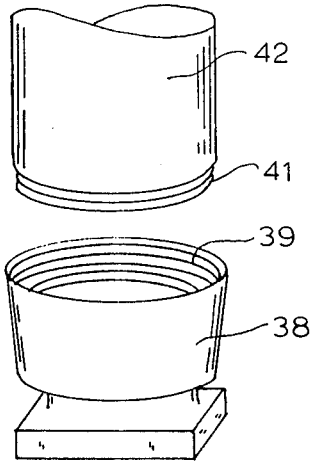
FIG. 18 is a perspective view of a container base, container fixture and a container of the invention.
Figure 19:
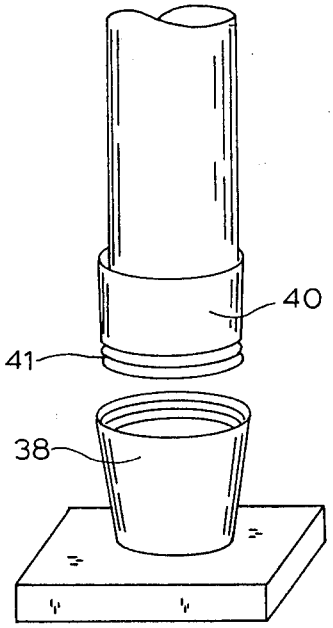
FIG. 19 is a perspective view of a marker, a threaded marker cap of the invention, and a container fixture on a container base.
Figure 22:
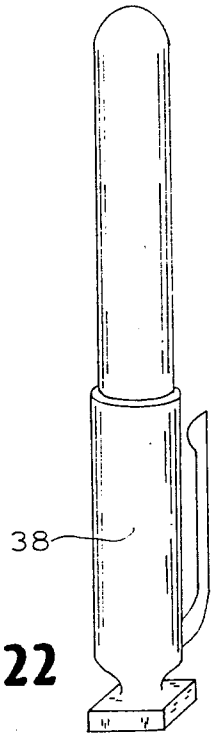
FIG. 22 is a perspective view of one embodiment of the invention in which the container fixture comprises a pen cap attached to a container base.

The bottoms of containers, such as bottles 37, may be attached directly, such as with glue or any other means of attachment, to the container attachment site 45 of any of the container bases for use in the receiving structures (FIG. 19). Alternatively, container fixtures that are adapted for particular items may be attached to the container bases to hold the various desk implements, bottles or jars firmly or the container bases may be formed in one piece with the container fixtures. Thus, a cup-structure 38 with interior threads 39 may be attached to any container base (FIG. 18). The edges of the container base may be wider than the container as shown in FIGS. 17 and 19 or, as shown in FIG. 18, the container base may be as narrow or narrower than the container for added stability and sturdiness and to allow the container to rest on the caddy 1. This design is particularly useful for cap structures that fit writing implements as shown in FIG. 22. The size of the cup structure 38 may be designed to fit the cap of a marker pen (FIG. 19) or the bottom of a bottle or other container or implement (FIG. 18) of any size. The caps of commercial marker pens or other writing implements may be replaced with special caps 40 having external threads 41 that fit the cup structure 38 and thread into the interior threads 39 (FIG. 19) or are unthreaded and are attached directly to or are part of a container base (FIGS. 21 and 22). Bottles 42 with external threads 41 on the bottom sides of the bottle 42 may be used to fit in the cup-structure 38 (FIG. 18). Alternatively, slip-on bottle covers or caps 46 may be formed to be externally threaded to fit into the cup structure. To allow enhanced locking, backward-projecting protrusions 43 on the top external threads 41 catch in notches 44 on the top interior threads 39 of the cup-structures 38 to keep the threaded bottle 42 or cap 40 from unscrewing unless sufficient pressure is exerted (FIG. 20). Any of the cup-structures 38 may also be attached directly to the upper plane 2 of the caddy 1 as shown in FIG. 1. A new bottle 42 or cap 40 may be screwed into the appropriately sized cup-structure 38 to replace used supplies or pens or to change the items kept on the caddy 1. As shown in FIG. 1, cup-structures 38 may be attached directly and permanently to the caddy 1 and not to container bases.

I claim:

1. A device for holding supplies, comprising:

(a) a support structure having at least one upper plane; said upper plane having a lower surface;

(b) said upper plane having at least one square receiving structure, said receiving structure having a circular interior area below the upper plane; and wherein each side of the square receiving structure has angled stops, said angled stops having a narrowed end toward the center of each side of the receiving structure;

(c) at least one square container base of a size to fit in the square receiving structure, said container base rotable from a first position to a second postion within the circular interior area, the square base has wedge shaped projections on each side of the base of a size to fit into the receiving structure, and (d) means for locking the container base into the receiving structure.

2. The device recited in claim 1, wherein:

(a) each side of the receiving structure has an indentation centrally located therein and in the lower surface of the upper plane;

(b) an upward protrusion of a diameter smaller than the diameter of the indentations is located on each corner of the container base; and (c) indentational stops are located on each side of the square receiving structure.

3. The device recited in claim 1, wherein:

(a) each side of the receiving structure has a hole centrally located therein and extending through the upper plane;

(b) an upward protrusion having a diameter smaller than the diameter of the holes is located on each corner of the container base; and (c) indentational stops are located on each side of the square receiving structure.

4. The device recited in claim 1 further comprising flexible catches positioned on each side of the receiving structure at the narrow end of the angled stops.

5. The device recited in claim 1, further comprising a container fixture attached to a container base.

6. The device recited in claim 5, wherein the container fixture comprises a cup structure having interior threads and an externally-threaded cap.

7. The device recited in claim 5, wherein the container fixture comprises a cup structure having interior threads and an externally-threaded bottle.

8. The device recited in claim 6, wherein protrusions on the externally threaded bottle may be locked into indentations on the interior threads.

9. The device recited in claim 7, wherein protrusions on the externally threaded bottle may be locked into indentations on the interior threads.

10. A device for holding supplies, comprising:

(a) a support structure having at least one upper plane; said upper plane having a lower surface, the lower surface of the upper plane along the parallel side edges of the receiving structure being slanted downward toward the inner back edge of the receiving structured;

(b) said upper plane having at least one rectangular receiving structure along an edge of the support structure, the upper plane along the side edges of the receiving structure overhanging the interior of the receiving structure, said upper plane having at least one upward indentation in its lower surface along each of the parallel side edges of the receiving structure; and (c) at least one rectangular container base having sides fitting inside the sides of the receiving structure; said container base having at least one upward protrusion on two opposite parallel sides that fit in the upward indentations and wedge shaped upward projections on the parallel sides of the container base.

11. The device recited in claim 10, wherein the indentations extend through the parallel sides of the receiving structure.

12. The device recited in claim 10, wherein the upper plane has a groove and the slanted lower surface of the upper plane is in the groove in the upper plane.

13. The device recited in claim 10, where a flexible catch is placed at the wide end of the slanted upper plane of the receiving structure.

14. The device recited in claim 10, further comprising a container fixture attached to a container base.

15. The device recited in claim 14, wherein the container fixture comprises a cup structure having interior threads and an externally-threaded cap.

16. The device recited in claim 14, wherein the container fixture comprises a cup structure having interior threads and an externally-threaded bottle.

17. The device recited in claim 15, wherein the interior threads have indentations and the externally threaded bottle has protrusions on the threads, said protrusions on the externally-threaded bottle lockable into the indentations on the interior threads.

18. The device recited in claim 16, wherein the interior threads have indentations and the externally-threaded bottle has protrusions on the threads, said protrusions on the externally-threaded bottle lockable into the indentations on the interior threads.

* * * * *